United States Patent [19]

Couper

[11] Patent Number: 4,726,843

[45] Date of Patent: Feb. 23, 1988

[54] ALUMINUM ALLOY POWDER PRODUCT

[75] Inventor: Malcolm J. Couper, Ennetbaden, Switzerland

[73] Assignee: BBC Brown, Boveri & Company Limited, Baden, Switzerland

[21] Appl. No.: 875,732

[22] Filed: Jun. 18, 1986

[30] Foreign Application Priority Data

Jun. 26, 1985 [CH] Switzerland ..... 2712/85

[51] Int. Cl.[4] ..... C22C 21/20

[52] U.S. Cl. ..... 75/249; 148/437; 419/23; 419/62; 419/66; 419/67; 420/528; 420/551; 420/552

[58] Field of Search ..... 420/528, 550, 551, 552; 148/437; 75/249; 419/23, 62, 66, 67

[56] References Cited

U.S. PATENT DOCUMENTS 4,347,376 8/1982 Ray et al. ..... 148/437

FOREIGN PATENT DOCUMENTS 1034260 7/1953 France .

OTHER PUBLICATIONS

Chemical Abstracts, Band 102, Nr. 6, 11 Feb. 1985, Columbus, Ohio (U.S.), Park et al.; "The Aging Phenomena in Rapidly Quenched Aluminum-Chromium-X Alloy".

Chemical Abstracts, Band 101, Nr. 6, 6 Aug. 1984, Columbus, Ohio (U.S.).

*Primary Examiner*—R. Dean

*Attorney, Agent, or Firm*—Oblon, Fisher, Spivak, McClelland & Maier

[57] ABSTRACT

Aluminum alloy, suitable for rapid quenching from a melt supersaturated with alloy components, which contains 2 to 5.5% by weight of Cr and 2 to 5.5% by weight of V, the remainder being Al, and may contain further added amounts of Mo, Zr, Ti or Fe, individually or in combination, up to a total content of not more than 1% by weight, the total content of all alloy elements being no more than 10% by weight. The simultaneous occurrence of the phases $Al_{13}Cr_2$ and $Al_{10}V$ in silid solution and as hardness-imparting dispersoids having a particle diameter of not more than 0.1 μm results in good high-temperature strength and thermal stability coupled with good ductility and toughness of the material. The comparatively Low Vickers hardness of, on average, only about 130 (HV) for the rapidly solidified alloys initially obtained make the powders readily processable. After the heat treatment, the Vickers hardness of the workpiece reaches values up to about 200 (HV).

12 Claims, No Drawings

ALUMINUM ALLOY POWDER PRODUCT

The invention relates to an aluminium alloy suitable for rapid quenching from a melt supersaturated with alloy components, of the class defined in the precharacterizing clause of claim 1.

It is known from powder metallurgy that the properties of compression-moulded and sintered or hot-pressed articles consisting of aluminium alloys are substantially determined by the properties of the powder used. In addition to the chemical composition, particle size and microstructure play an important role. The last two properties depend in turn essentially on the cooling rate. This should be as high as possible. Various processes and material compositions have been proposed for achieving greater high-temperature strengths for articles made of an aluminium alloy (cf. U.S. Pat. Nos. 4,379,719; 4,389,258 and EP-A No. 0 000 287). Through high cooling rates, segregation is avoided and the solubility limit for alloy elements is increased so that, by means of suitable heat treatment or thermochemical treatment, finer precipitates having high strength can be obtained. It is also possible to form advantageous metastable phases which cannot be established under conventional quenching conditions. Other advantageous properties which can be achieved by high cooling rates are increased corrosion resistance and greater toughness of the alloys.

The aluminium alloys cited in the above publications predominantly belong to a type which has a relatively high iron content. In the primary solidified state as powders, flakes or ribbons present after rapid quenching from a melt, these alloys have very high stabilities and present difficulties during subsequent compaction to give compression-moulded articles. Either higher pressures or higher temperatures are required, which on the one hand is expensive and on the other hand entails the danger that the optimum microstructure for the end product may not be achieved (cf. J. Duszcuzyk and P. Jongenburger, TMS-AIME Meeting, New York, Feb. 24–28 1985; R. J. Wanhill, P.M. Aerospace Materials Conference, Berne, November 1984; G. J. Hildeman, D. J. Lege and A. K. Vasudevan, High Strength PM Aluminium Alloys, eds. Koczak and Hildeman, 1982, page 249).

Chromium-containing and manganese-containing aluminium alloys which permit the formation of supersaturated solid solutions are softer and more ductile and accordingly easier to compress and to process as powders (cf. P. Furrer and H. Warlimont, Mat. Sci. and Eng. 28, 1977, 127; R. Yearim and D. Schecktman, Met. Trans. A., 13A, 1891–1898, 1982; EP-A No. 0 105 595; I. R. Hughes, G. J. Marshall and W. S. Miller, 5th Conference on Rapidly Quenched Metals, Würzburg, September 1984).

Although noteworthy results, in particular increased high-temperature strength in the temperature range from 250° to 300° C.—where conventional aluminium alloy articles possess no significant strength properties have been achieved to date, the properties of the proposed workpieces produced by powder metallurgy are still unsatisfactory. This applies in particular to the hightemperature strength, the toughness, the ductility and the fatigue strength in the temperature range from room temperature to about 250° C.

There is therefore a great need for alloys which have been further improved, for the production of suitable powders, in particular in respect of their combined properties.

It is the object of the invention to provide aluminium alloys which are suitable for the production of ultrafine-particles powders from melts which are supersaturated with alloy components, the said powders possessing improved mechanical and structural properties. The particular objective is to obtain compositions which, under the proposed cooling conditions, form ductile, readily processable structures and phases, the strength properties and toughness of which can be further improved by suitable heat treatments.

This object is achieved by the features stated in the characterizing clause of claim 1.

The concept of the invention comprises improving the properties of the binary Al/Cr alloys (supersaturated solid solution, formation of $Al_{13}Cr_2$ dispersoids) by alloying them with vanadium and, if appropriate, small amounts of other additives. Because it is possible to form the intermetallic compound $Al_{10}V$, which has a low density, that is to say a large specific volume, the amount by volume of strength-increasing, finely divided dispersoids is dramatically increased in the end product. Moreover, the simultaneous presence of chromium and vanadium, by exerting a mutual reinforcing effect, has an advantageous influence on the thermal stability, the hightemperature strength and the toughness and also gives an alloy having good ductility.

The invention is described with reference to the embodiments below.

EMBODIMENT 1

An aluminium alloy having the following composition was prepared:

Cr=5% by weight

V=2% by weight

Al=remainder

First, an alloy was prepared by melting the pure components Al, Cr and V in a silicon carbide crucible in an induction furnace in vacuo, and the alloy was poured into a water-cooled copper ingot mould. The solidified ingot weighed about 1.5 kg. It was divided mechanically into smaller pieces, which were introduced into a silicon carbide crucible of an atomizing apparatus. The container of this apparatus was then evacuated down to a residual pressure of about 1.5 Pa, flooded with nitrogen, evacuated again, flooded again with nitrogen and evacuated once more. Under these conditions, the charge was melted by means of an inductive heating apparatus and brought to a temperature of 1150° C. The container was then filled with nitrogen, and the inductive heater was switched off. By raising the graphite stopper in the crucible, the orifice in its base was opened, and the melt fed into the atomizer nozzle underneath. This nozzle, which was equipped with a central sleeve axially displaceable in height, was now fed with nitrogen under a pressure of 8 MPa. The powder suspended in the nitrogen stream was then separated off in a cyclone. After about 3 minutes, atomization was complete. The operating parameters—low flow rate of the melt, high gas velocity of the atomizing nitrogen were set so that a powder having a very fine particle size was produced. The largest particle diameter of the powder was 40 μm, the mean diameter being about 25 μm. Any particles obtained which exceeded the dimension of 40 μm were held back by a screen. In this type of atomization process, the mean cooling rate for the alloy droplets atomized to particles was greater than $10^6$° C./s.

The alloy powder was then introduced into a thin-walled cylindrical aluminium can having a diameter of 70 mm and a height of 250 mm. The can was evacuated, heated to 450° C., and kept at this temperature in vacuo for 2 hours. The residual gas pressure was about 0.15 Pa. The can was then closed, so that it was vacuum-tight, by clamping the extraction nozzle, and was placed in a press. The encapsulated alloy powder was compressed at 450° C. to 96% of the theoretical density of the compact material. The compacted and cooled moulding was freed from its aluminium shell by mechanical processing and was used as a slug in an extruder. A rod having a diameter of 15 mm was extruded at a temperature of 460° C. (reduction ratio 1:22).

The strength and ductility values were monitored in the course of the process and for the end product. One of the properties measured for material freshly solidified from the melt, without any heat treatment, was a Vickers hardness of 120 (HV), indicating good ductility. The Vickers hardness at room temperature determined for a ready-prepared extruded specimen after a heat treatment at a temperature of 400° C. for a period of 1 hour was 190 (HV). This increase not only indicates the marked effect of the hardness-imparting dispersoids but also their outstanding thermal stability.

EMBODIMENT 2

The aluminium alloy to be investigated had the following composition:

Cr=4.5% by weight
V=2.5% by weight
Al=remainder.

An alloy was prepared by melting suitable Al/Cr and Al/V master alloys in an alumina crucible under an inert gas atmosphere in an induction furnace, and an ingot weighing about 1 kg was cast. 400 g of this ingot were melted by an inductive procedure in an apparatus, and the melt was spun as a jet under high pressure, in the first gas phase, against the periphery of a cooled copper disc rotating at a peripheral speed of 12 m/s (so-called "melt-spinning" process). As a result of the high cooling rate, a ribbon about 30 μm thick and consisting of ultra-fine particles was obtained. The ribbon was crushed, and milled to fine-particled powdered. A cylindrical capsule of ductile aluminium sheet, having a diameter of 60 mm and a height of 60 mm, was then filled with the powder, evacuated and welded. The filled capsule was then hot-pressed at 420° C. and under a pressure of 200 MPa, to the full theoretical density. The capsule was removed by mechanical processing and the moulded speciment was used as a slug of 40 mm diameter in an extruder with a reduction ratio of 25:1, and extruded at 400° C. to give a rod of 8 mm diameter.

Testing gave the following results: the ribbon which initially solidified from the supersaturated melt as a result of rapid quenching had a Vickers hardness of 135 (HV). The ready-prepared extruded specimen was subjected to a heat treatment at a temperature of 400° C. for 2 hours. It has a Vickers hardness of 205 (HV), indicating high strength.

EMBODIMENT 3

An aluminium alloy having the following composition was first prepared:

Cr=5.1% by weight
V=3.0% by weight
Al=remainder.

The alloy was atomized to an ultrafine-particled powder having a mean particle size of 20 μm by the method stated under Example 1, and the powder was compressed, compression-moulded, and further processed to a round rod.

The specimens had the following strengths:

untreated, room temperature:
tensile strength=520 MPa
elongation at break=10%
after a heat treatment at 250° C./100 h, tested at a temperature of 250° C.:
high-temperature tensile strength=300 MPa
elongation at break=25%.

The latter values are indicative of the excellent strength, toughness and ductility properties of this alloy. These properties are just as high at a temperature of 250° C. as the corresponding properties at room temperature for conventional aluminium alloys prepared by customary methods.

EMBODIMENT 4

The alloy obtained by melting had the following composition:

Cr=4.5% by weight
V=2.0% by weight
Mo=1.0% by weight
Al=remainder.

The preparation was carried out using exactly the same procedure as that described under Example 2.

The ribbon directly solidified from the melt had a Vickers hardness of 140 (HV). After a heat treatment at 400° C. for a period of 1 hour, the ready-prepared specimen had a Vickers hardness (measured at room temperature) of 185 (HV).

The invention is not restricted to the embodiments. The aluminium alloy can in principle consist of 2 to 5.5% by weight of Cr, 2 to 5.5% by weight of V and, if appropriate, one or more of the metals Mo, Zr, Ti or Fe in a total amount of not more than 1% by weight, the remainder being aluminium, and the total content of all alloy elements being no higher than 10% by weight.

The aluminium alloy should preferably contain at least 1.2% by weight of the phase $Al_{13}Cr_2$ and at least 1.1% by weight of the phase $Al_{10}V$ incorporated in a solid solution.

The structure of the aluminium alloy should furthermore preferably contain at least 1.2% by weight of the phase $Al_{13}Cr_2$ and at least 1.1% by weight of the phase Al10V as a finely divided dispersoid having a particle diameter of not more than 0.1 μm.

I claim:

1. An aluminum alloy product consisting essentially of at least 1.2% by weight of the phase $Al_{13}Cr_2$ and at least 1.1% by weight of the phase $Al_{10}V$, which is produced by:

(a) melting an aluminum alloy consisting essentially of 2 to 5.5% by weight of Cr, and 2 to 5.5% by weight of V, the remainder being Al, or 2 to 5.5% by weight of Cr, 2 to 5.5% by weight of V, and one or more metals selected from the group consisting of Mo, Zr, Ti and Fe in an amount of not more than 1% by weight, the remainder being Al, and wherein the total content of all alloy elements in each of the above alloys is not more than 10% by weight, to thereby produce a melt super-superated with alloy components;

(b) pouring the melted alloy to form an ingot;

(c) comminuting the ingot into smaller pieces;

(d) melting the comminuted pieces under reduced pressure;

(e) atomizing the melted alloy under high pressure to form an ultra-fine powder, whereby rapid cooling is achieved; and (f) compressing the ultra-fine powder at elevated temperature.

2. The aluminum alloy product according to claim 1, containing 5% by weight of Cr and 2% by weight of V.

3. The aluminum alloy product according to claim 1, containing 4.5% by weight of Cr and 2.5% by weight of V.

4. The aluminum alloy product according to claim 1, containing 4.5% by weight of Cr, 2% by weight of V and 1% by weight of Mo.

5. The aluminum alloy product according to claim 1, containing 5.1% by weight of Cr and 3.0% by weight of V.

6. The aluminum alloy product according to claim 1, containing at least 1.2% by weight of the phase $Al_{13}Cr_2$ and at least 1.1% by weight of the phase $Al_{10}V$ as a finely divided dispersoid having a particle diameter of not more than 0.1 μm.

7. The aluminum alloy product according to claim 1, wherein in step (d), said comminuted pieces are melted by induction heating under a reduced pressure nitrogen atmosphere.

8. The aluminum alloy product according to claim 1, wherein in step (e), said melted alloy is atomized under higher pressure nitrogen.

9. The aluminum alloy product according to claim 1, wherein in step (f), said ultra-fine powder is compacted to about 96% of theoretical density.

10. The aluminum alloy product according to claim 7, wherein said induction heating is at a temperature of about 1150° C.

11. The aluminum alloy product according to claim 1, wherein said ultra-fine powder produced by atomizing the melted alloy under high pressure nitrogen has a mean particle diameter of about 25 μm, with particle diameters of up to about 40 μm.

12. The aluminum alloy produce according to claim 1, wherein said compression of said ultra-fine powder is at a temperature of about 450° C.

* * * * *